United States Patent [19]

Gill

[11] Patent Number: 5,020,594

[45] Date of Patent: Jun. 4, 1991

[54] METHOD TO PREVENT GAS INTRUSION INTO WELLBORES DURING SETTING OF CEMENTS

[75] Inventor: James A. Gill, Houston, Tex.

[73] Assignee: Sans. Gas. Inc., Enid, Okla.

[21] Appl. No.: 545,427

[22] Filed: Jun. 28, 1990

[51] Int. Cl.[5] ..... E21B 21/08; E21B 33/16; E21B 47/06

[52] U.S. Cl. ..... 166/250; 166/285; 166/291; 166/292; 175/50; 175/65

[58] Field of Search ..... 166/250, 278, 285, 291, 166/292, 293, 309; 175/50, 65, 71, 69, 72

[56] References Cited

U.S. PATENT DOCUMENTS

| | | | |
|---|---|---|---|
| 2,293,904 | 8/1942 | Kail | 166/250 |
| 3,196,946 | 7/1965 | Lauffer | 166/285 |
| 3,277,962 | 10/1966 | Flickinger et al. | 166/285 X |
| 3,382,933 | 5/1968 | Hottman | 175/50 |
| 3,399,723 | 9/1968 | Stuart | 175/72 X |
| 3,804,058 | 4/1974 | Messenger | 166/292 |
| 3,865,201 | 2/1975 | Haden | 166/250 |
| 3,907,034 | 9/1975 | Suman, Jr. | 166/250 |
| 4,003,431 | 1/1977 | Novotny | 166/250 |
| 4,120,360 | 10/1978 | Messenger | 166/293 |
| 4,300,633 | 11/1981 | Stewart | 166/250 |
| 4,440,226 | 4/1984 | Suman, Jr. | 166/250 |
| 4,475,591 | 10/1984 | Cooke, Jr. | 166/254 |
| 4,577,689 | 3/1986 | Dotson | 166/250 |
| 4,655,286 | 4/1987 | Wood | 166/285 |
| 4,716,973 | 1/1988 | Cobers | 175/50 |
| 4,721,160 | 1/1988 | Parcevaux | 166/293 |

*Primary Examiner*—George A. Suchfield

*Attorney, Agent, or Firm*—Dunlap, Codding, Peterson & Lee

[57] ABSTRACT

A method of cementing wells to minimize gas intrusion by applying pressures on the subsurface formations substantially equal to the natural formation pressures.

7 Claims, 2 Drawing Sheets

METHOD TO PREVENT GAS INTRUSION INTO WELLBORES DURING SETTING OF CEMENTS

BRIEF SUMMARY OF THE INVENTION

1. Field of the Invention

The present invention relates generally to well drilling procedures and, more specifically, to a method of placing cement which does not cause gas intrusion into a wellbore.

2. Background of the Invention

The present invention provides an economical and efficient method for preventing the intrusion of formation fluids, usually, but not always, gas, into wellbores.

During the placement and initial stages of "setting" of cement, used in casing wells, gas bubbles may migrate upward through the unset cement slurry; creating permanent channels after set. These channels permit communication between formations or a formation and the surface. As a result, many difficult and expensive well control and production problems occur.

Until now it has been presumed that the gas was allowed to enter the wellbore due to a loss in hydrostatic head caused by the setting of the cement. Under that theory, cement column hydrostatic head pressures were thought to be reduced to less than the pressure of permeable formations because of shrinkage and gelation bridging in the cement as it sets. It was believed the reduced pressure in the wellbore allowed the natural formation pressure to flow gas bubbles into the wellbore and then to percolate upward through the setting cement, thereby forming channels in the cement. This led to elaborate attempts to mitigate the loss of hydrostatic head by using fluid loss control additives; cement permeability-reducing additives; foaming agents; increased thixotropy; gelation reduction (to achieve "right angle set"); pressuring techniques; cement expansion; etc. These additives and techniques are expensive, and their results in controlling gas intrusion have been erratic and indeterminate.

This invention is based on a heretofore unrecognized mechanism (ballooning) which explains the cause of gas intrusion into wellbores during cementing operations. The present invention provides a method for minimizing gas intrusion by reducing the design density of the cement slurry when a ballooning situation is encountered.

DETAILED DESCRIPTION

Figure 1:
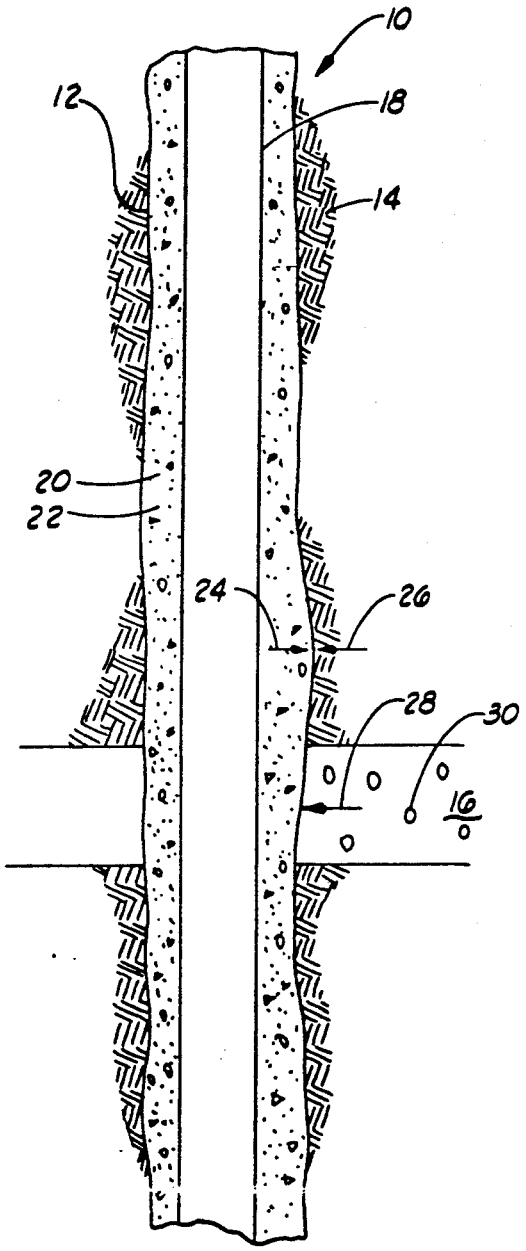
FIG. 1 is a schematic cross-section of a portion of a well.

Referring to the drawings in detail, and particularly FIG. 1, reference character 10 generally designates a well. The well 10 has borehole walls 12 extending through a shale formation 14 and a fluid bearing sand formation 16. A pipe 18, usually called a casing, inserted into the well 10 leaves an annular cavity 20 between the casing 18 and the borehole walls 12. The relative size of cavity 20 is enlarged in FIG. 1 for illustration purposes.

When completing this section of the well 10, a cement slurry 22 is placed in the cavity 20 to seal the formations 14 and 16 from the wellbore. The slurry 22 exerts a pressure, represented by arrow 24, against the borehole wall 12. The pressure 24 is generally due to the density of the slurry 22, but it also includes mechanically induced pressures created from placement procedures, such as pumping the slurry.

Previously it was believed that so long as the pressure 24 was greater than the natural pressure of the formations 14 or 16, as represented by arrows 26 and 28 respectively, the slurry 22 would prevent fluid 30, usually gas, from entering the well 10. This has not been the case, and in fact as disclosed by this invention the use of a slurry with a high density increases the influx of fluid into the well.

Figure 2:
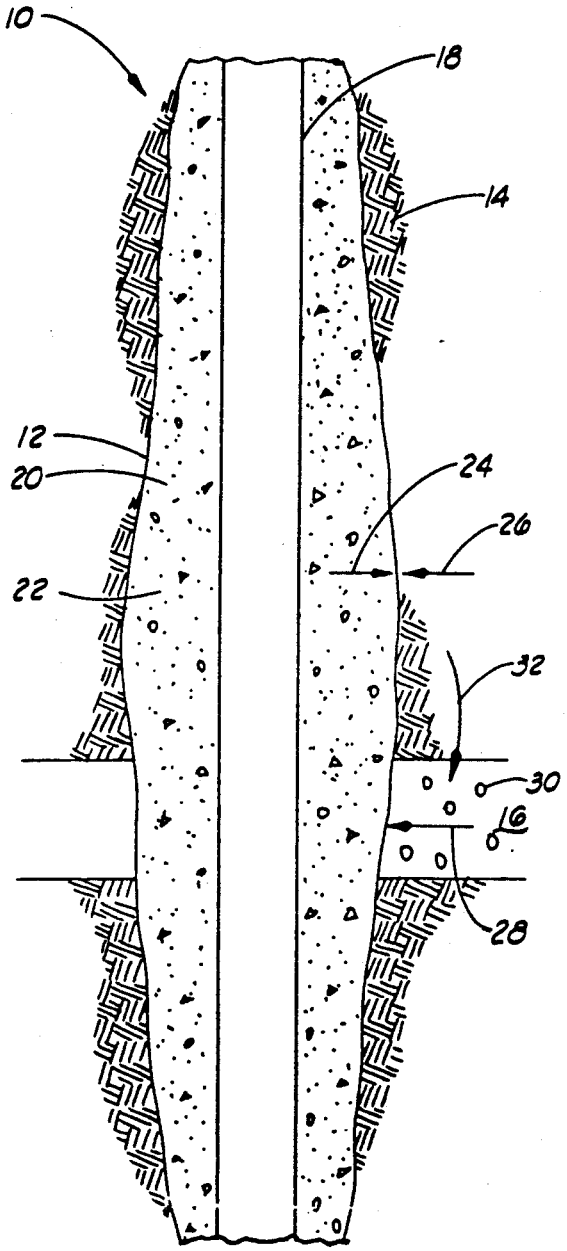
FIG. 2 is a schematic cross-section of the same well with the borehole walls ballooned.

As shown in FIG. 2, when a drilling mud or cement slurry 22 with a high density is used, the increased pressure 24 can force the shale formation 14 into a plastic behavior mode where the wellbore walls 12 are ballooned, or bulge outward, from their original position. As the wellbore walls are pushed outward, they in turn push on the surrounding shale water mixture. An induced pressure, represented by arrow 26, is created in the shale or other impermeable formation (such as chalk). The wellbore walls will continue to expand until the induced pressure 26 equals the pressure 24 exerted by the slurry 12. The expansion of the well bore wall is small, fractions of an inch, but the balloon of induced pressure surrounding the wellbore is larger - - hundreds of feet.

The induced pressure 26 exists for some distance into the shale formation, which is squeezing on the adjacent sand formation 16, (where the induced pressure is leaking off into the sand through a natural shale filter cake) as is represented by arrow 32. If the pressure 24 is increased, the wellbore walls will expand further and if the pressure 24 is decreased, the wellbore walls 12 will contract.

Each time the pressure inside the wellbore exerted by the slurry 22 is decreased (such as by stopping the pumps), a small quantity of fluid 30 (usually gas) is milked, or aspirated by the pressure wave in its adjacent shale moving back toward the now reduced pressure in the wellbore. Thus, the source of the fluid is usually a sand formation with a natural pressure considerably lower than the mud/cement density. Heretofore, a fluid influx has been presumed to be from a permeable formation with a high natural pressure and very close to that of the mud weight used in drilling. Thus, when fluid influx was observed, the density of the slurry 22 was increased. However, this makes the ballooning and the associated influx of fluid 30 worse. The ballooned shale body acts as a giant hydraulic accumulator.

To prevent ballooning, one must measure the natural formation pressures of the formations to be cemented. In doing so one may not rely upon mud weights used during drilling or obtained from "charged" RFT's (Repeat Formation Tester). The mud weights are unreliable because many wells are drilling in a greatly over balanced, ballooning mode, and charged RFT's reflect the induced pressure in the shale rather than its original, natural pressure. However, one may use well log derived pressure plots for determining the natural formation pressures.

Figure 3:
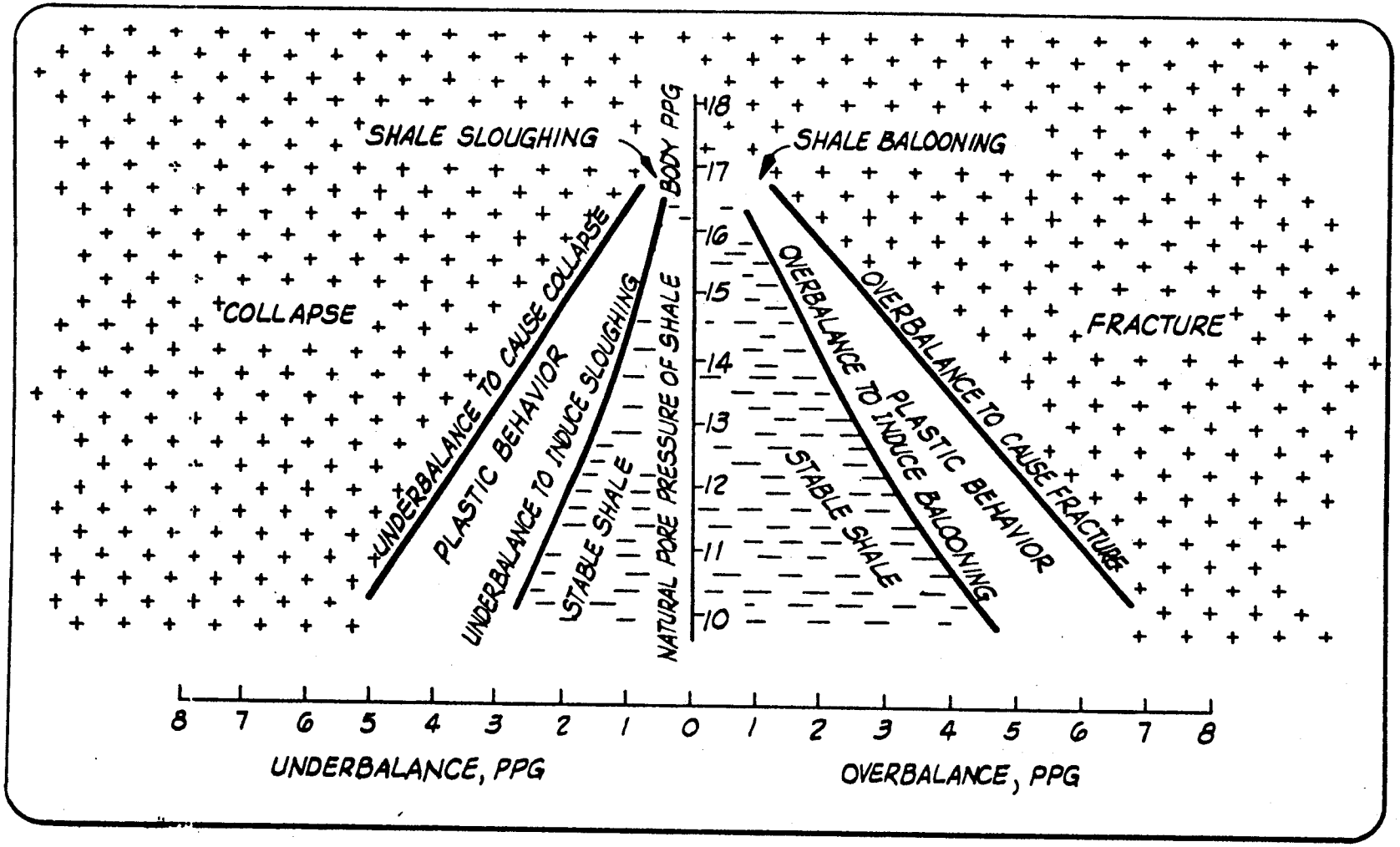
FIG. 3 is a graph of formation pressures versus borehole pressures.

Once the natural pressures of the formation to be cemented are known, the slurry should be designed and mixed so its density will fall within a range which will produce a pressure in the non-ballooning stable shale margin as illustrated in FIG. 3. In the case of normally pressured wells—the vast majority—FIG. 3 indicates that cement slurry densities greater than 4.0 or 5.0 ppg over the formation pressure can induce ballooning. This means that, in normally pressured wells, any slurry density greater than about 13.0 ppg can cause gas intrusion. It should be noted that FIG. 3 is only illustrative, and the precise stable shale margin will vary, with shale composition, depth, and borehole angle.

The density of the slurry may be reduced by adjusting the composition (cement/water ratio), or by adding light weight aggregate or other density reducing additives. Prior to placing the slurry, the density of drilling mud in the borehole should be adjusted to match the density of the slurry to be used. If the well was drilled in a ballooning mode, the lesser density will be required to allow the balloon to relax. Normal prudent placement procedures should be used including pipe movement if desired. It is important to avoid pressure surges such as may be caused by pumping, or running casing too fast.

Changes may be made in the steps and procedures disclosed herein without departing from the spirit and scope of the invention as defined in the following claims.

I claim:

1. A method for preventing fluid intrusion in wells comprising the steps of:

measuring the natural formation pressures of the formation through which the well passes;

placing a slurry into an annulus, between a pipe and a borehole wall, so that the slurry exerts a pressure against the borehole wall; and maintaining the pressure against the borehole wall below a pressure that will cause the borehole wall to balloon.

2. The method of claim 1 where the step of maintaining the pressure against the borehole wall is further comprised of adjusting the density of the slurry so it will exert a pressure, against the borehole wall, generally equal to the natural formation pressures.

3. The method of claim 2 wherein the slurry is a cement slurry and the step of adjusting the density of the slurry is further comprised of adding density-reducing additives to the slurry.

4. The method of claim 2 wherein the slurry is drilling mud.

5. In a method of completing a well, the steps of:

measuring the natural formation pressures of the formations to be cemented;

adjusting the density of the drilling mud to apply a pressure on the surrounding formations substantially equal to the natural pore pressure of said formations prior to completion of the drilling operation; and displacing the drilling mud with a cement slurry with the application of pressures on the surrounding formations substantially equal to the natural formation pore pressures, whereby the formations are not ballooned.

6. The method of claim 5 wherein the pressure applied by the cement slurry includes controlling the density of the slurry.

7. The method of claim 6 wherein the slurry contains density-reducing additives.

* * * * *